US005783985A

United States Patent [19]

Kowalik et al.

[11] Patent Number: 5,783,985

[45] Date of Patent: Jul. 21, 1998

[54] COMPRESSIBLE BODY FOR FUSE

[75] Inventors: Joseph W. Kowalik, Skokie; Heraclio R. Gomez, Northbrook; G. Todd Dietsch, Park Ridge, all of Ill.

[73] Assignee: Littelfuse, Inc., Des Plaines, Ill.

[21] Appl. No.: 842,966

[22] Filed: Apr. 25, 1997

[51] Int. Cl.[6] ..... H01H 85/08; H01H 85/38

[52] U.S. Cl. ..... 337/278; 337/227

[58] Field of Search ..... 337/227, 290, 337/273, 276, 159, 160, 222, 246, 278, 279, 282, 295, 296, 161, 280, 224, 225, 232, 292

[56] References Cited

U.S. PATENT DOCUMENTS

| | | | |
|---|---|---|---|
| 3,143,615 | 8/1964 | Kozacka . | |
| 3,348,007 | 10/1967 | Urani . | |
| 3,601,737 | 8/1971 | Baird | 337/159 |
| 3,766,509 | 10/1973 | Cameron | 337/279 |
| 4,267,543 | 5/1981 | Arikawa | 337/255 |
| 4,276,531 | 6/1981 | Davis . | |
| 4,283,700 | 8/1981 | Akiyama . | |
| 4,417,224 | 11/1983 | Ross . | |
| 4,417,226 | 11/1983 | Asdollahi et al. . | |
| 4,533,895 | 8/1985 | Kowalik et al. . | |
| 4,636,765 | 1/1987 | Krueger . | |
| 4,656,453 | 4/1987 | Reeder . | |
| 5,162,773 | 11/1992 | Shiozaki | 337/201 |
| 5,187,463 | 2/1993 | DiTroia et al. . | |
| 5,345,210 | 9/1994 | DiTroia et al. . | |

FOREIGN PATENT DOCUMENTS

| | | |
|---|---|---|
| B-73284/94 | 7/1993 | Australia . |
| 40 42 043 A1 | 12/1990 | Germany . |
| PCT/US94/07747 | 2/1995 | WIPO . |

*Primary Examiner*—Leo P. Picard
*Assistant Examiner*—Anatoly Vortman
*Attorney, Agent, or Firm*—Wallenstein & Wagner, Ltd.

[57] ABSTRACT

The invention is a component for an electrical or electronic fuse. In one preferred embodiment of the invention, the component comprises a body of resilient, compressible material having a front face and a rear face. A fusible element is disposed within the body of resilient material, and the fusible element extends through a passageway within the body. At least one of the faces includes a flange section extending outwardly from that one face.

7 Claims, 2 Drawing Sheets

COMPRESSIBLE BODY FOR FUSE

DESCRIPTION

1. Technical Field

The invention relates to an improved compressible body for an electrical or electronic fuse. In particular, the invention is a component for a fuse which includes at least one face and a flange around at least a portion of that face or, alternatively, which includes a recessed face.

2. Background of the Invention

Electrical or electronic fuses are well-known in the art. Smaller fuses are used to protect low amperage electrical circuits. Such smaller fuses typically include a fusible wire, terminals, and perhaps a protective, insulating covering.

In contrast, larger fuses are required for protection of higher amperage electrical circuits. These larger fuses can be cylindrical in shape and include large, thick fusible links, sand as an arc-quencher, and various kinds of arc barriers. One such arc barrier is shown and described in U.S. Pat. No. 5,345,210 (the "'210 patent"), issued on Sep. 6, 1994, to Swensen and Kowalik. For example, FIGS. 4 and 5 of the '210 patent show a body 62 of resilient, compressible insulating material. The compressible insulating material is disclosed as being an elastomer, preferably a silicone rubber with a durometer hardness of 10. FIG. 1 of the present application shows the prior art compressible body 62 of the '210 patent.

As may be seen in FIG. 1 of the present application, the compressible body 10 has substantially flat planar faces. The flat planar faces of the prior art compressible body are arbitrarily referred to as the front face 12 and rear face 14. The tops of both the front face 12 and rear face 14 are joined by a horizontal top portion 16.

As described at columns 5 and 6 of the '210 patent, when the fuse containing this structure is subjected to overload conditions, the four fusible elements 18 will melt. When these elements 18 melt, for example, along their central portions, the structural integrity of and the electrical continuity through the element 18 is destroyed. This design characteristic of the fuse dictates that flow of current through the fuse is subsequently interrupted.

It has been found, however, that the current flow interruption resulting from the opening of the circuit using this design can be, in theory, defeated. This can occur when the molten solder, or other fusible metal, found in these elements 18 moves up the front wall 12, over the horizontal top portion 16, and then down the rear wall 14, where it can contact the portion of the element 18 adjacent the rear wall 14. The resulting "solder bridge," formed from the molten, repositioned, rehardened solder between the portion 20 of the element 18 adjacent to the front wall 12 and the portion 22 of the element 18 adjacent to the rear wall 14, can reform the circuit that was intended to have been interrupted. Thus, the purpose of the fuse, i.e. to interrupt the circuit by melting and disintegrating the central portion of the element 18, is defeated by the formation of the "solder bridge."

It was determined that it would be desirable to create a solution to this potential problem.

SUMMARY OF THE INVENTION

The invention is a component for an electrical or electronic fuse. In one preferred embodiment of the invention, the component comprises a body of resilient, compressible material having a front face and a rear face. A fusible element is disposed within the body of resilient material and extends through a passageway within the body. At least one of the faces includes a flange section extending outwardly from that one face.

In a further aspect of the invention, at least one end of the fusible element is entirely contained within the flange. In other words, the end of the fusible element does not extend beyond a plane perpendicular to the extremities of the flange.

In a still further aspect of the invention, at least one end of the fusible element extends beyond the flange. In other words, the end of the fusible element extends beyond a plane perpendicular to the extremities of the flange.

In a still further aspect of this first embodiment of the invention, the fusible element is made of solder.

A flange is not strictly necessary for the present invention. Accordingly, a second embodiment of the invention comprises a component for an electrical or electronic fuse, which component comprises a body of resilient, compressible material having at least one recessed face. This embodiment also includes a fusible element, and a passageway within that body through which the fusible element extends. This fusible element may also be made of solder.

DETAILED DESCRIPTION OF THE PREFERRED EMBODIMENT

Figure 2:
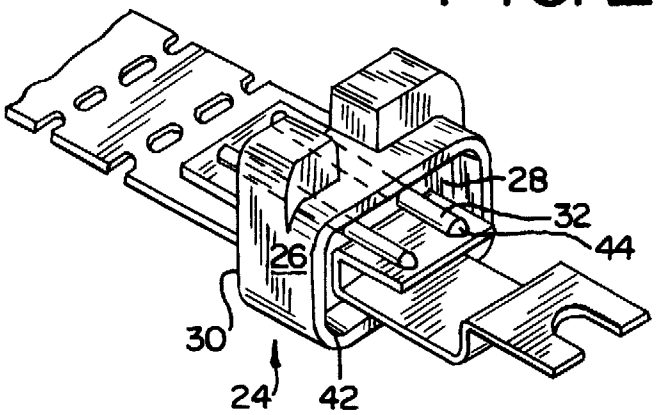
FIG. 2 is a perspective view of a portion of a fusible component of the fuse of FIG. 3, including a body of resilient, compressible material having a front face and a rear face, and having a flange section extending outwardly from the front face.
Figure 1:
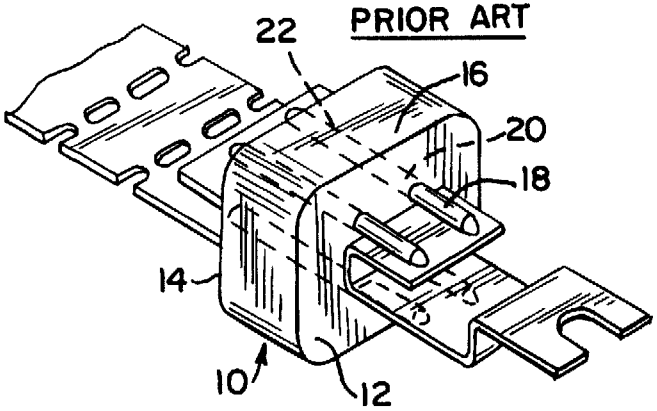
FIG. 1 PRIOR ART
FIG. 1 shows a prior art compressible body from U.S. Pat. No. 5,345,210.
Figure 3:
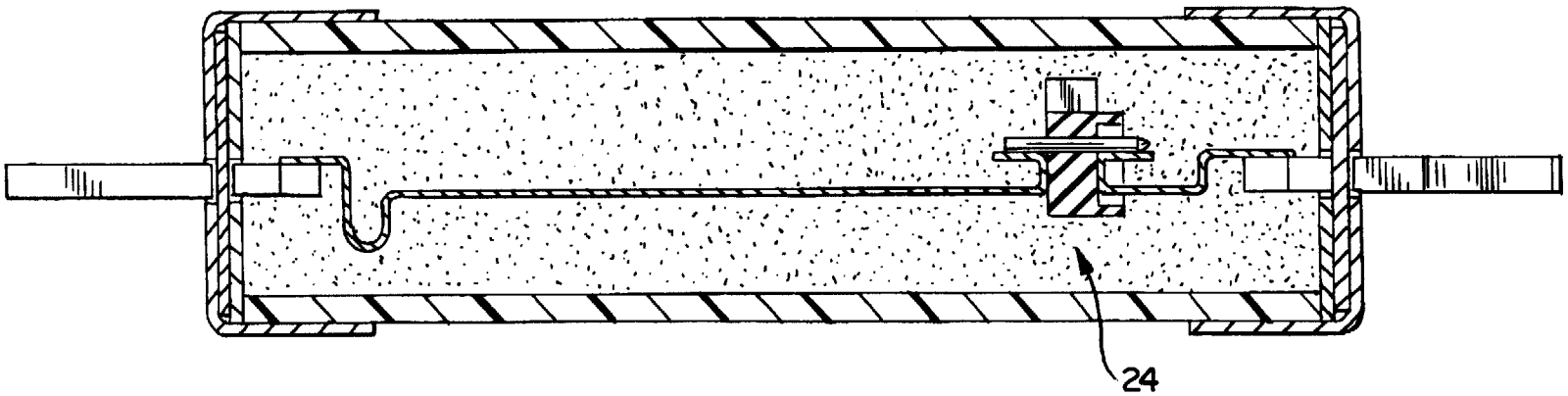
FIG. 3 is a side, cutaway view of a Class R fuse in which the body of resilient, compressible material in accordance with the invention may be used.

The structure of embodiments of the present invention is shown in FIGS. 2–8, while FIG. 1 depicts a structure from the prior art. Although the environment in which the present invention may be used is not limited, one environment is the Class R fuse, as shown in FIG. 3, and as described in somewhat more detail in the '210 patent. The '210 patent also discloses materials, alloys, and metals that may be used for construction of the present invention. Accordingly, the disclosures of the '210 patent are incorporated herein by reference.

Figure 4:
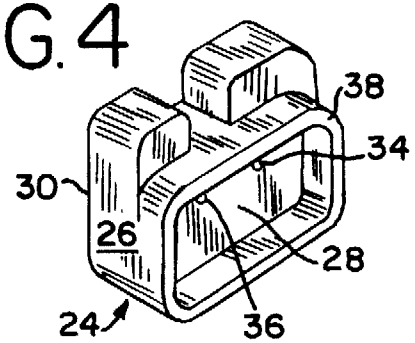
FIG. 4 is an enlarged perspective view of the body of resilient, compressible insulating material shown in FIGS. 2–3, but without the fusible elements normally contained within that body.

As may best be seen in FIG. 4, the invention is a component 24 for an electrical or electronic fuse. In one preferred embodiment of the invention, the component 24 comprises a body of resilient, compressible material 26. The preferred material for this body 26 is an elastomer. The preferred elastomer is a silicone rubber with a durometer harness of approximately 10.

In the specification, the term "compressible" is intended to refer to a material which may collapse upon, and in that way at least partially obscure, any relatively small openings which are formed in a block of that material. Particularly, for the purposes of this invention, a compressible material is one in which (1) a relatively small hole may be formed with a hole-forming instrument; and (2) when the hole-forming instrument is removed from that hole, the surrounding compressible material will collapse upon and substantially obscure that hole. The purpose of this substantial obscuration of the hole is to aid in arresting the movement of arcs ("arc-back") through the length of the fuse upon overload conditions leading to the opening of a portion of the fuse.

Figure 5:
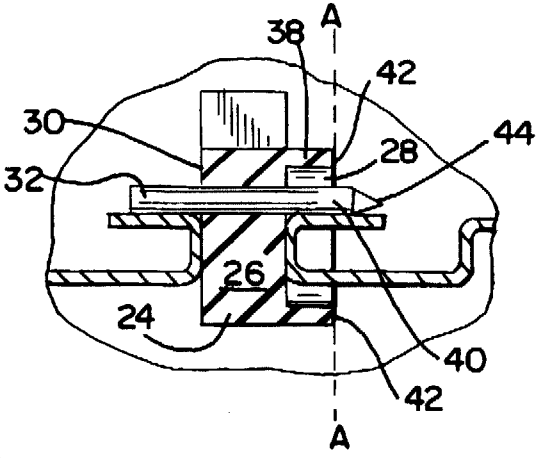
FIG. 5 is an enlarged, sectional view of the body of resilient, compressible material of FIGS. 3 and 4.

As may be seen in FIGS. 2, 4 and 5, the body 26 has a front face 28 and a rear face 30. A fusible element 32 is disposed within the body of resilient material 26, and the fusible element 32 extends through one of two passageways 34 and 36 within the body 26.

At least one of the faces, in this case front face 28, includes a flange 38 extending outwardly from that face 28.

Figure 8:
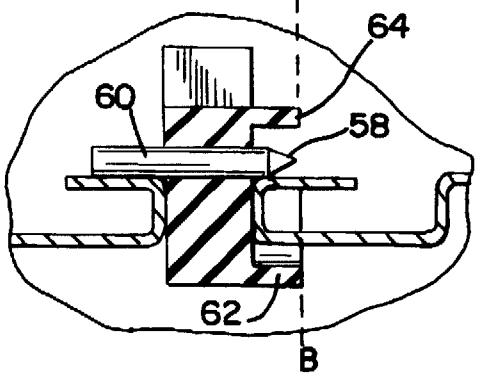
FIG. 8 is an enlarged sectional view of the body of resilient, compressible material of FIGS. 3 and 4, but with a relatively shorter fusible element.

In a further aspect of the invention, at least one end 58 of the fusible element 60 is entirely contained within the flange 62. This embodiment is illustrated in FIG. 8. Particularly, as may be seen in FIG. 8, the conical end 58 of the fusible element 60 does not extend beyond a plane B—B that is perpendicular to the extremities 64 of the flange 62.

In a still further aspect of the invention, as shown in FIGS. 2 and 5, at least one end 44 of the fusible element 32 extends beyond the flange 38. In other words, the end 44 of the fusible element 32 extends beyond a plane A—A perpendicular to the extremities 42 of the flange 38.

In a still further aspect of this first embodiment of the invention, the fusible element 32 is made of solder. Other well-known conventional metals or alloys may be used for the fusible element 32. These include 51.2% tin, 30.6% lead, and 18.2% cadmium solid wire solder, or 63% tin and 37% lead solid wire solder.

A full flange is not strictly necessary for the present invention. Accordingly, in another embodiment of the invention otherwise identical to that described above, the body of resilient, compressible material has at least one recessed face. With a face that is recessed from the extremities of the body 24, any molten solder from the fusible element 32 has a longer and less direct path to traverse if it is to form a "solder bridge."

Figure 7:
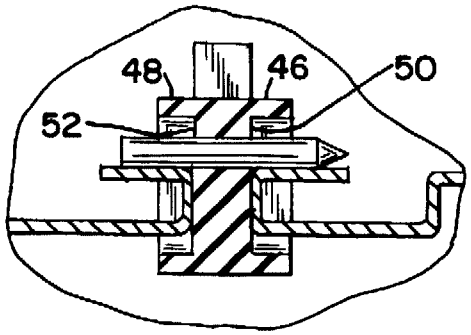
FIG. 7 is a sectional view of the body of resilient, compressible material of FIG. 6, but secured to the remaining components of the fuse, and containing fusible elements.
Figure 6:
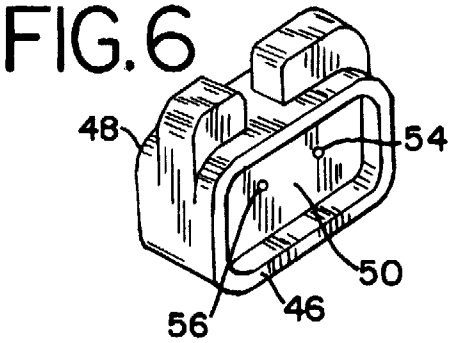
FIG. 6 is an enlarged perspective view of an alternative body of resilient, compressible insulating material in accordance with the invention.

FIGS. 6 and 7 depict another embodiment of the present invention. In this embodiment, there are two flanges 46 and 48, resulting in two effectively recessed faces, a front face 50 and a rear face 52. Two passageways 54 and 56 extend from the front face 50 through to the rear face 52.

Accordingly, the invention is a means of preventing the formation of a "solder bridge" upon melting of the fusible element. Whether the embodiment of the invention includes one or more flanges, or does not include flanges and instead includes one or more recessed faces, the construction of the present invention inhibits the formation of a "solder bridge" in two ways. First, in order to form a "solder bridge," the molten solder must traverse a greater linear distance between the portion 20 of the element 18 adjacent to the front wall 12 and the portion 22 of the element 18 adjacent to the rear wall 14. Second, the molten solder must make a greater number of turns, and one or more 180° turns, if it is to form a "solder bridge." Without a flange or recessed face, fewer turns, and no turns of greater than 90°, are necessary for the formation of a "solder bridge."

What I claim is:

1. A component for an electrical or electronic fuse, said component comprising:

a. a body of resilient, compressible material having a front face and a rear face;

b. a fusible element;

c. a passageway within said body through which said fusible element extends; and d. at least one of said faces including a flange section extending outwardly from said face.

2. The component of claim 1, wherein at least one end of said fusible element is entirely contained within said flange.

3. The component of claim 1, wherein said fusible element is made of solder.

4. The component of claim 2, wherein said fusible element is made of solder.

5. A component for an electrical or electronic fuse, said component comprising:

a. a body of resilient, compressible material having at least one recessed face;

b. a fusible element; and c. a passageway within said body through which a fusible element extends.

6. The component of claim 5, wherein said fusible element is made of solder.

7. A component for an electrical or electronic fuse, said component comprising:

(a) a body of resilient, compressible material having a front face and a rear face;

(b) a fusible element;

(c) a passageway within said body through which said fusible element extends;

(d) at least one of said faces including a flange section extending outwardly from said face; and (e) at least one end of said fusible element extending beyond said flange.

* * * * *